US010857533B2

(12) United States Patent
Yiu

(10) Patent No.: US 10,857,533 B2
(45) Date of Patent: Dec. 8, 2020

(54) PIPETTE TIP LOADING AND UNLOADING MECHANISM FOR SINGLE ROW MULTICHANNEL PIPETTORS

(71) Applicant: Felix H. Yiu, Covina, CA (US)

(72) Inventor: Felix H. Yiu, Covina, CA (US)

( * ) Notice: Subject to any disclaimer, the term of this patent is extended or adjusted under 35 U.S.C. 154(b) by 247 days.

(21) Appl. No.: 15/943,604

(22) Filed: Apr. 2, 2018

(65) Prior Publication Data

US 2018/0221864 A1 Aug. 9, 2018

Related U.S. Application Data

(63) Continuation of application No. 14/451,382, filed on Aug. 4, 2014, now abandoned.

(51) Int. Cl.
*B01L 3/02* (2006.01)
*B01L 9/00* (2006.01)

(52) U.S. Cl.
CPC ..... *B01L 3/0279* (2013.01); *B01L 9/543* (2013.01); *B01L 2200/023* (2013.01); *B01L 2200/026* (2013.01); *B01L 2200/04* (2013.01); *B01L 2200/0689* (2013.01); *B01L 2300/14* (2013.01)

(58) Field of Classification Search
None
See application file for complete search history.

(56) References Cited

U.S. PATENT DOCUMENTS

2002/0176803 A1* 11/2002 Hamel ..... G01N 35/028 422/511
2012/0258026 A1* 10/2012 Naumann ..... G01N 35/04 422/521
2013/0323140 A1* 12/2013 Motadel ..... G01N 35/1074 422/524
2014/0199216 A1* 7/2014 Moriarty ..... B01L 3/0279 422/522

* cited by examiner

*Primary Examiner* — Kathryn Wright
(74) *Attorney, Agent, or Firm* — Loza & Loza, LLP; Derek Yeung

(57) ABSTRACT

A mechanism that provides an improved method of loading and unloading a row of disposable pipette tips onto a handheld multichannel pipettor. A single button for tip load and unload operations is simpler than the current method of using a separate mechanism for ejecting the tips. The tips are configured in a rigid collar which is held by a clamp on the pipettor. An upward force combined with a sealing gasket that mates with the top of the pipette tips is used to provide the seal between the tips and the pipettor. This eliminates the requirement to "press downward" with excessive force in order to force the pipette tips onto a protruding sealing part. The loading and unloading of tips will be more reliable and repeatable, this providing better pipetting results. The low forces of the loading and unloading operations reduce the chance of repetitive stress injury for the operator.

8 Claims, 9 Drawing Sheets

PIPETTE TIP LOADING AND UNLOADING MECHANISM FOR SINGLE ROW MULTICHANNEL PIPETTORS

CROSS-REFERENCE TO RELATED APPLICATIONS

This application is a continuation application of U.S. patent application Ser. No. 14/451,382 filed in the United States Patent and Trademark Office on Aug. 4, 2014, the entire content of which is incorporated herein by reference.

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM, LISTING COMPACT DISC APPENDIX

Not Applicable

BACKGROUND OF THE INVENTION

The present invention is used in the field of small volume liquid pipetting using the air displacement pipetting technique. These air displacement pipettors are used to pipette or aspirate and dispense (transfer) small volumes of liquid, a typical volume range being 1 microliter to 1 milliliter of liquid. A common method for containing the liquid is to use a disposable pipette tip to hold the liquid after it is aspirated and before it is dispensed. The most common material to produce the pipette tips is polypropylene. The advantage of a disposable pipette tip in comparison to a reusable fixed tip is that the liquid being pipetted only comes into contact with the disposable tip, which is discarded after each use thus preventing any carryover or sample-to sample contamination in between pipetting operations. The reusable fixed tips must be washed in between each pipetting operation, and even the washing protocol does not guarantee complete elimination of carryover. Because of this the use of disposable pipette tips is very common for this application.

Air displacement pipettors can be constructed to pipette one liquid sample at a time, or more than one. When more than one sample is pipetted at the same time, this is commonly referred to as a multichannel pipettor. Commonly available multichannel air displacement pipettors may use a number of disposable tips arranged in a single row, or a number of pipette tips arranged in a grid fashion (array pattern). It is a standard in the industry to pipette to and from micro titer plates that have an industry-accepted spacing of liquid containers, or wells. These micro titer plates, also called microplates, commonly have 96 wells arranged in an 8×12 grid or 384 wells arranged in a 16×24 grid. The spacing between wells is defined by the industry-accepted standard. This allows multichannel air displacement pipettors to be constructed that are able to access multiple wells all at once for pipetting, either in a single row or as a grid.

A common application for this area is the use of a handheld multichannel air displacement pipettor that has an arrangement of pipetting channels in a single-file row. The number of channels can vary, with common examples being 4,8, 12, 16, or 24. These handheld pipettors all must load and unload the single row of disposable pipette tips for each pipetting operation. In order to do this, the bottom edge of the pipetting mechanism typically has a mechanical protuberance for each disposable pipette tip, and the pipette tip is loaded onto the pipettor by forcing this protuberance into the top cavity of the pipette tip using a downward force. It is critical that the loading of the pipette tip onto the pipettor create an airtight seal each time and for each tip; if an airtight seal is not present then the precision and accuracy of the liquid pipetting operation will be compromised. Because of this requirement, a fairly significant amount of downward force is required to "force" or "press" the top of the pipette tip onto the protuberance so that a good seal is created. This seal is created due to the design tolerances of both the protuberance and the tip; the tip is dimensionally designed such that it will fit very tightly over the protuberance and therefore distort slightly and create a forced fit. This downward force is multiplied by the number of pipette tips that need to be loaded onto the pipettor, for example loading 8 pipette tips requires 8 times the force as loading a single pipette tip. After the pipetting operation has been performed, the disposable pipette tips must then be removed in preparation for the next operation. The removal of these tips from the pipettor also requires an equivalent amount of force.

Multichannel handheld air displacement pipettors that are currently in use as prior art are designed with a variety of methodologies to accommodate the loading and unloading of the disposable pipette tips. All of the prior art requires that the pipette tips be loaded in the fashion described above. One limitation of the prior art is that the forces required to load and unload the pipette tips create a difficult manual operation for the user of the pipette. It can be difficult to use enough force to properly load and unload the tips. There is substantial and well-documented risk of repetitive stress injury for operators who are required to perform multiple pipetting operations using these devices.

Another limitation of the prior art is that if the tips are not all properly and consistently loaded onto the pipettor, the airtight seal which is critical for the pipetting operation will be compromised, causing the precision of the results to be less than optimal.

Yet another limitation of the prior art is that the design tolerances of the protuberances (which may also be referred to as cones, inserts, tip fittings, bullets, and other names) are difficult to manufacture precisely.

Yet another limitation of the prior art is that the design tolerances of the tips at the upper part where they mate with the protuberances are difficult to manufacture precisely.

BRIEF SUMMARY OF THE INVENTION

The present invention is a loading and unloading mechanism combined with a new method of holding a single row of disposable pipette tips for use on a multichannel handheld air displacement pipettor. It uses a novel new design that allows a single row of pipette tips to be loaded with an upward clamping force, which provides a simpler and easier method for loading the tips while at the same time maintaining a tight air seal to ensure precise and accurate pipetting operations. The invention also allows the pipette tips to be removed from the pipettor with a simple operation that reverses the loading operation.

It is an objective of the invention to create a unitary entity between a single line or rectangular array of multiple pipette tips and a tip collar that provides structural rigidity to allow for ease of installation between the assembly set of pipette tips and a pipetting head adaptor.

It is another objective of the invention to create an airtight seal between the multiple pipette tips and the pipettor mechanism using an upward clamping force.

It is yet another objective of the present invention to allow the user to easily attach the multiple pipette tips to the pipettor mechanism without the need to apply any downward force.

It is yet another objective of the present invention to allow the attachment of the multiple tips to the pipettor mechanism in a repeatable fashion, eliminating variabilities in the tip heights which can adversely affect results.

It is yet another objective of the present invention to allow the user to easily remove the multiple pipette tips from the pipettor mechanism without using excessive force.

It is yet another objective of the present invention to create a handheld pipettor mechanism that is simpler and less expensive to manufacture.

It is yet another objective of the present invention to allow the use of a variety of disposable pipette tips with the loading and unloading mechanism without the need to manufacture the tips to fit a specific sealing protuberance.

These and other advantages and features of the present invention are described with specificity so as to make the present invention understandable to one of ordinary skill in the art.

DETAILED DESCRIPTION OF THE INVENTION

Figure 1:
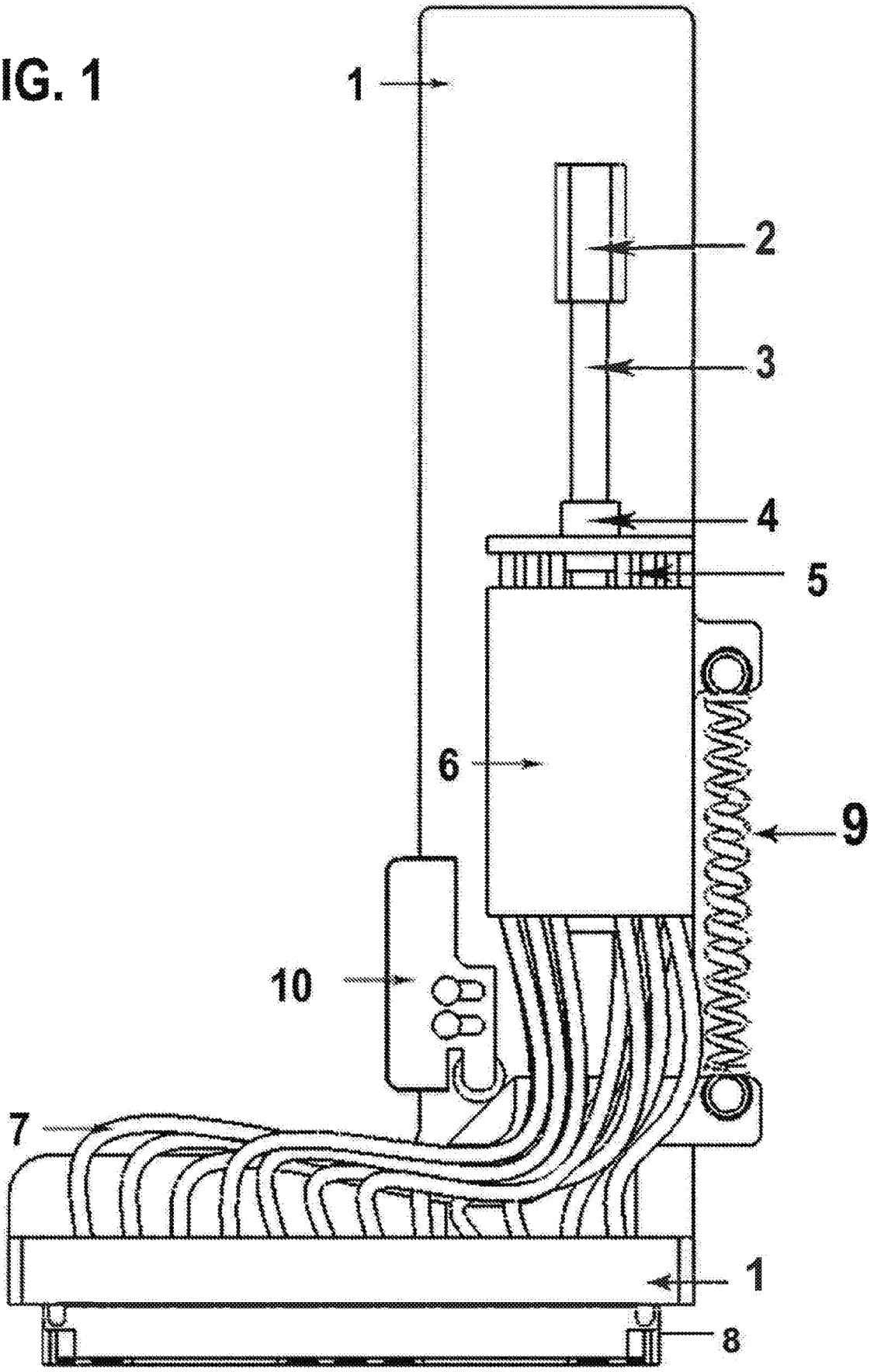
FIG. 1 is a side view of a 12-channel handheld air displacement pipettor showing the clamping mechanism and trigger button of the current invention.

FIG. 1 is an example of a handheld air displacement pipettor. The common parts used for pipetting are the frame 1 to contain the various parts, a linear motor 2, linear screw 3, and linear bearing 4 which are used to provide the vertical motion required to activate pipetting, a row of pistons 5 within a piston vacuum chamber 6 which are used to generate the air displacement function that allows pipetting of liquid to occur, and a series of tubes 7 that are used to connect the piston vacuum chamber to the disposable pipette tips. This drawing and description illustrates a 12-channel pipettor, but it is not meant to be limited to that number of channels. The present invention will apply to single-row handheld pipettors with any number of channels. Also shown in FIG. 1 is the clamp which will act as the sealing mechanism for the pipette tips, the spring 9 which is used to provide the required force to maintain the seal of the pipette tips when they are loaded, and the trigger button 10 which is used by the operator to load and unload the pipette tips. The spring 9 is shown as the mechanism to produce the upward force required to move the clamp 8 upward and create the tip seal, however other methods could be used to generate this force.

Figure 2A:
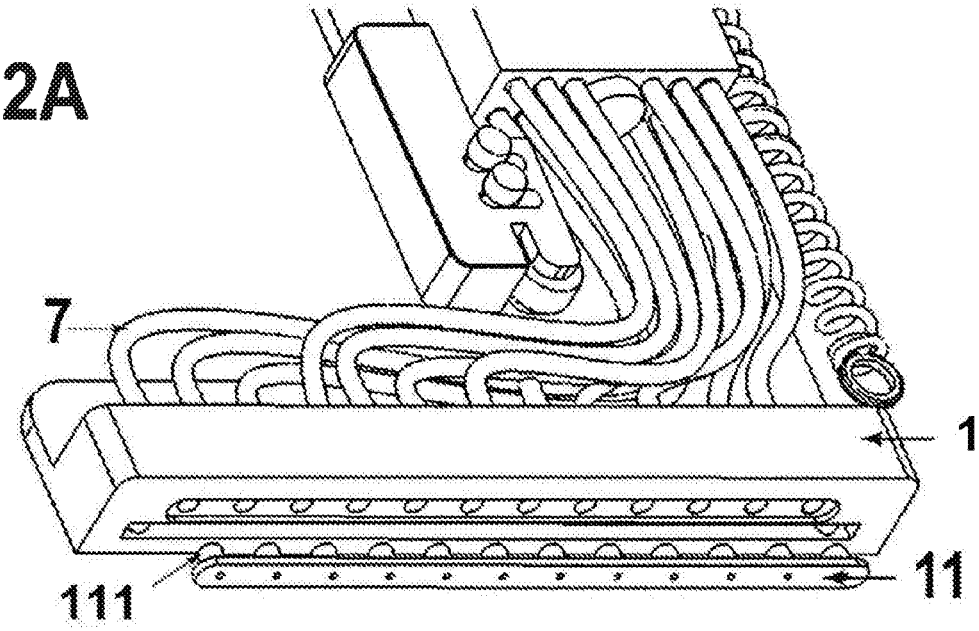
FIG. 2A is a first perspective view of the rubber gasket that provides the airtight seal.
Figure 2B:
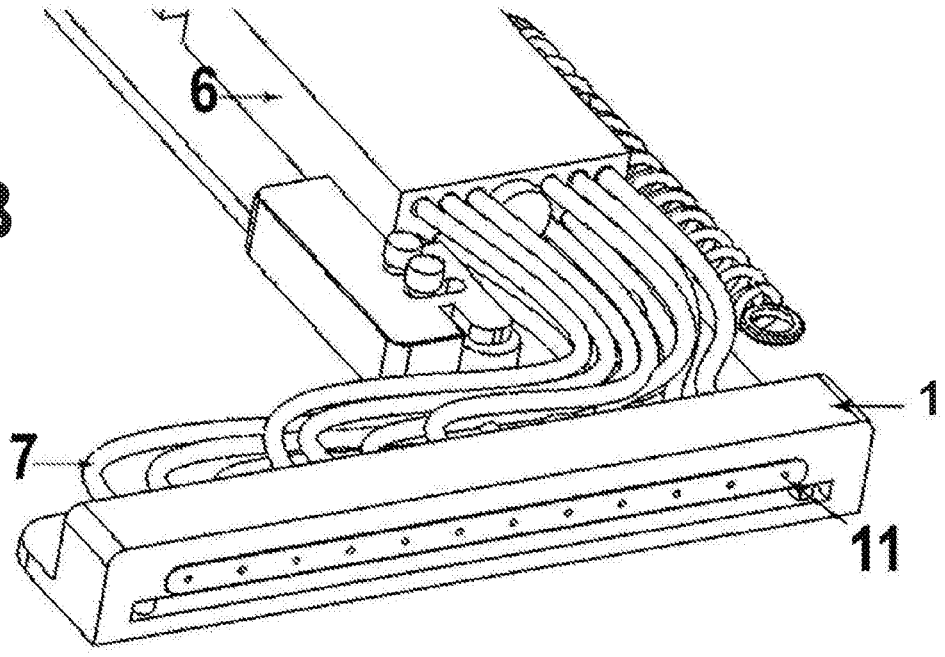
FIG. 2B is a second perspective view of the rubber gasket that provides the airtight seal.

In FIGS. 2A and 2B the gasket 11 is shown. The gasket is used to provide the airtight seal between the top edge of the pipette tips and the tubes 7 which lead to the piston vacuum chamber 6. The gasket can be manufactured from rubber, silicon, or any other similar compliant material as defined by the scope of this invention. FIG. 2A provides a perspective view of the gasket 11 before it is installed into the clamp 8. The gasket 11 is manufactured with upward extending sealing rings 111 that help provide the airtight connection to the tubes 7. FIG. 2B shows the gasket 11 installed into operational position in the frame 1.

Figure 3:
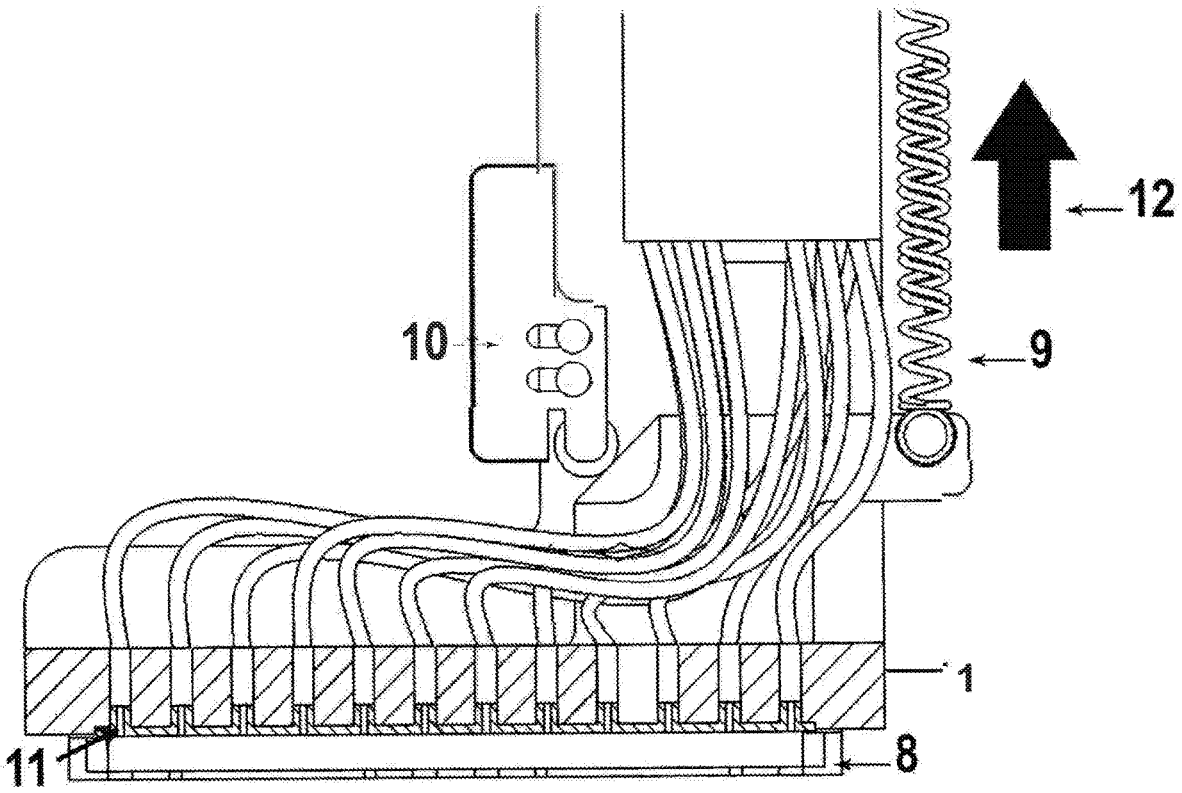
FIG. 3 is a cutaway view of a 12-channel handheld air displacement pipettor showing the rubber gasket installed along with the clamping mechanism and trigger button.

FIG. 3 is a close-up side view of the handheld air displacement pipettor with the gasket 11 installed with the clamp 8 in the rest position. In this rest position, there is a constant upward force 12 being applied to the clamp 8 by the spring 9. This constant upward force 12 is used to hold the clamp securely in position.

Figure 4:
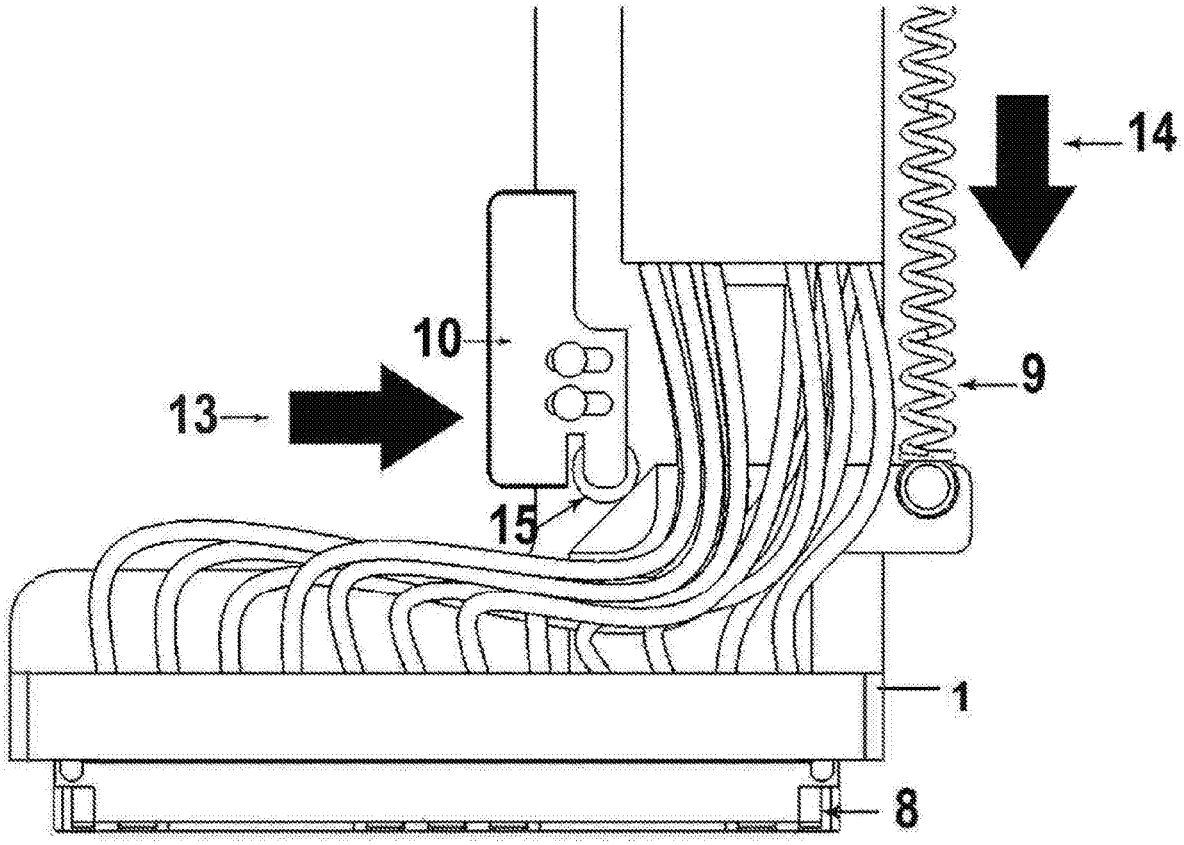
FIG. 4 is a side view of a 12-channel handheld air displacement pipettor showing the clamping mechanism in the tip loading position.

FIG. 4. illustrates how the trigger button 10 is used to move the clamp 8 downward so that it will be in position for the loading of the tips. When the operator applies a sideways force 13 on the trigger button 10 the cam 15 is pressed against the clamp 8 in such a manner that the clamp 8 moves downward. This downward movement of the clamp 8 creates a downward force 14 which causes the spring 9 to stretch.

Figure 5A:
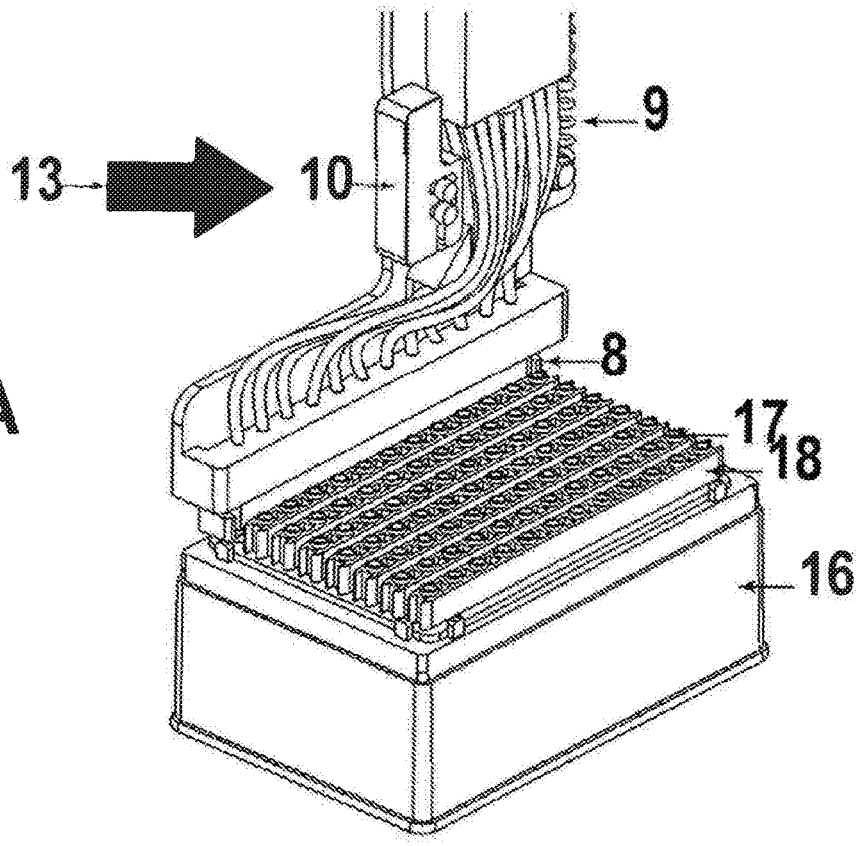
FIG. 5A is a perspective view showing a tip rack containing rows of 12 disposable pipette tips being accessed by the pipettor with the clamp in the tip loading position.
Figure 5B:
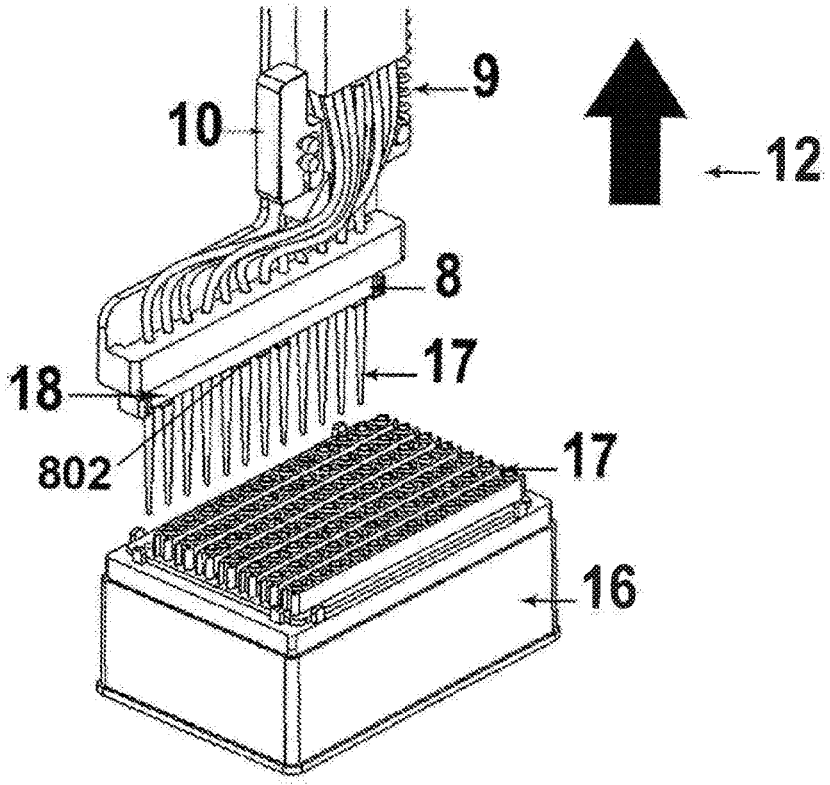
FIG. 5B is a perspective view showing a single row of pipette tips loaded onto the pipettor and removed from the tip storage box.

In FIGS. 5A and 5B the tip loading step is shown. The tips 17 are located in a collar 18 which is used to position and hold a row of tips 17, in this case 12 tips. The collars 18 are stored in a tip rack 16 for convenience. In order to load a row of tips 17, the operator continues to apply sideways force 13 to the trigger button 10 which keeps the clamp 8 in the downward position. Then the pipettor is lowered so the clamp 8 is in position and some parts 802 (also see FIG. 6) of the clamp 8 are placed below a collar 18 holding a row of tips 17. Once the clamp 8 is in position, the operator simply releases the pressure on the trigger button 10. This will allow the spring 9 to retract, and the upward tension force 12 of the spring will cause the clamp 8 to move to its locked position as shown in FIG. 5B. This will allow the collar 18 with the row of tips 17 to be lifted from the tip rack 16 as the tips are now loaded onto the pipettor.

Figure 6:
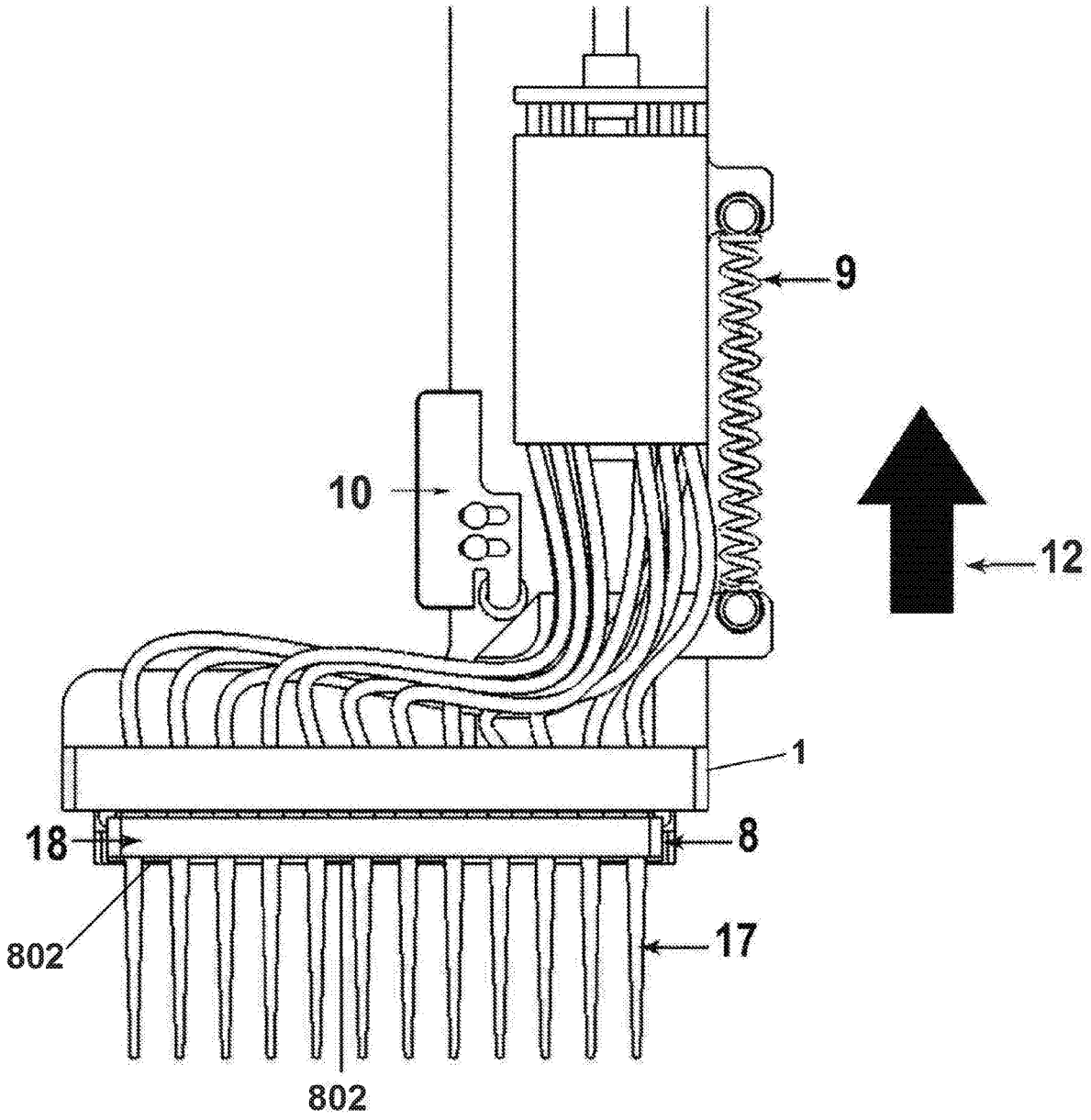
FIG. 6 is a side view that shows the row of pipette tips loaded onto the pipettor and the clamping mechanism in the ready position.

FIG. 6 shows a side view of the pipettor with the tips 17 and collar 18 in the loaded position. The user no longer has to apply any force to the trigger button 10 since the tips 17 and collar 18 are held in position by the upward force 12 generated by the spring 9, which is acting on the clamp 8 causing it to lock onto the collar 18. In this position, called the ready state, the pipettor is ready for use.

Figure 7:
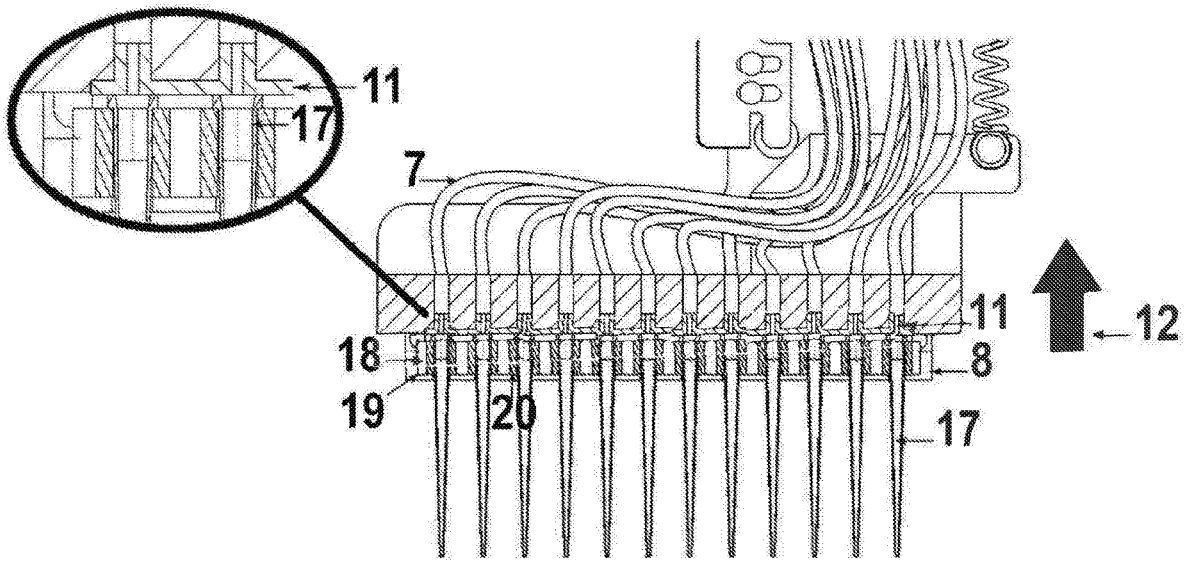
FIG. 7 is a side close-up cutaway view that shows the positioning of the clamping mechanism onto the row of pipette tips and the position of the rubber gasket in relation to the tips.

A close-up view of the pipettor in the ready state is shown in FIG. 7 to illustrate how this design achieves the required airtight seal for optimal pipetting. The top edge 19 of the clamp 8 is positioned tightly under the bottom edge 20 of the collar 18. This top edge 19 of the clamp 8 is generating upward force 12 onto the bottom edge 20 of the collar 18 as generated by the spring 9. The top edges of the tips 17 are in contact with the gasket 11. The upward force 12 that is applied to the tips 17 by way of the clamp 8 and the collar 18 cause the top edges of the tips 17 to be firmly pressed into the gasket 11 with sufficient force to provide an airtight seal to the tubes 7.

Figure 8A:
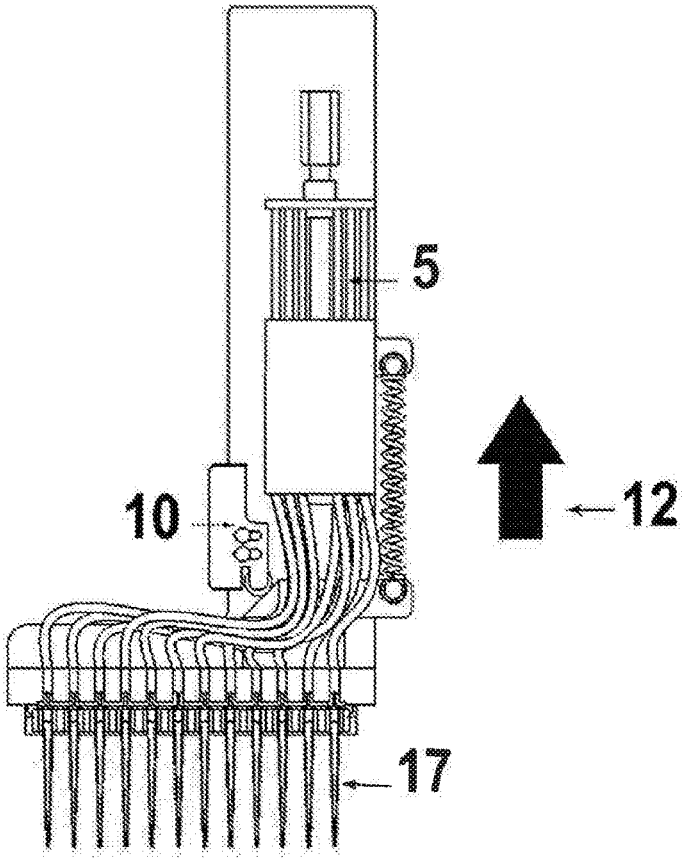
FIG. 8A is a first cutaway view of the handheld air displacement pipettor showing the position of the clamping mechanism during the aspirate phase of the pipetting operation.
Figure 8B:
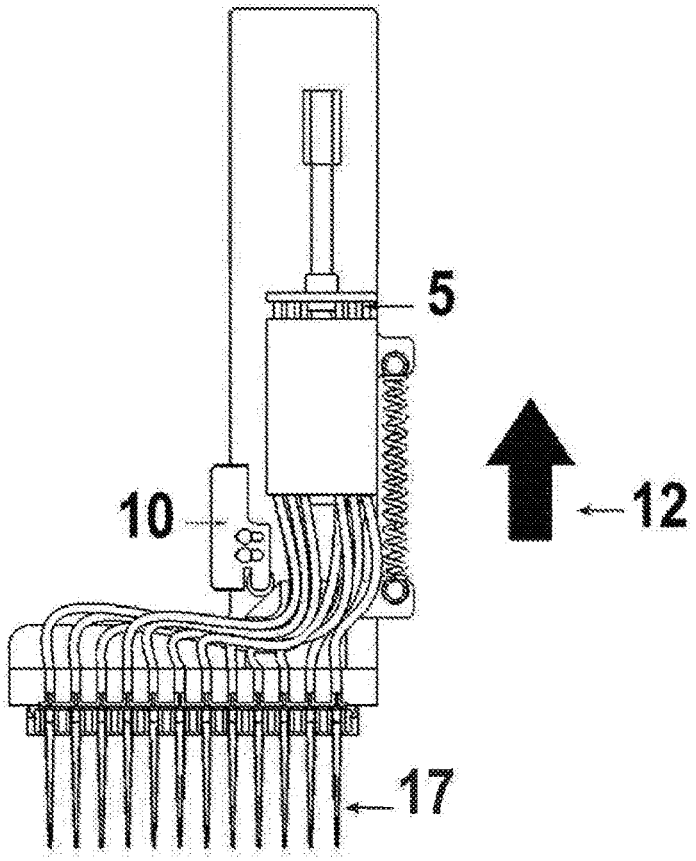
FIG. 8B is a second cutaway view of the handheld air displacement pipettor showing the position of the clamping mechanism during the dispense phase of the pipetting operation.

As shown in FIGS. 8A and 8B, once the tips 17 have been loaded as described above, the pipettor can be used for aspirating and dispensing with no further intervention of the part of the user on the trigger button 10. The tips 17 will remain firmly locked in place during the aspirate function shown in FIG. 8A and during the dispense function shown in FIG. 8B. In FIG. 8A the pistons 5 are shown in the higher position just after an aspirate operation. In FIG. 8B the pistons 5 are shown in a lower position as is typical for a dispense operation. As the pipettor is used for the aspiration and dispense functions and the trigger 10 is left untouched, there is constant upward force 12 being applied to the collar and tip assembly due to the force generate by the spring 9.

Figure 9:
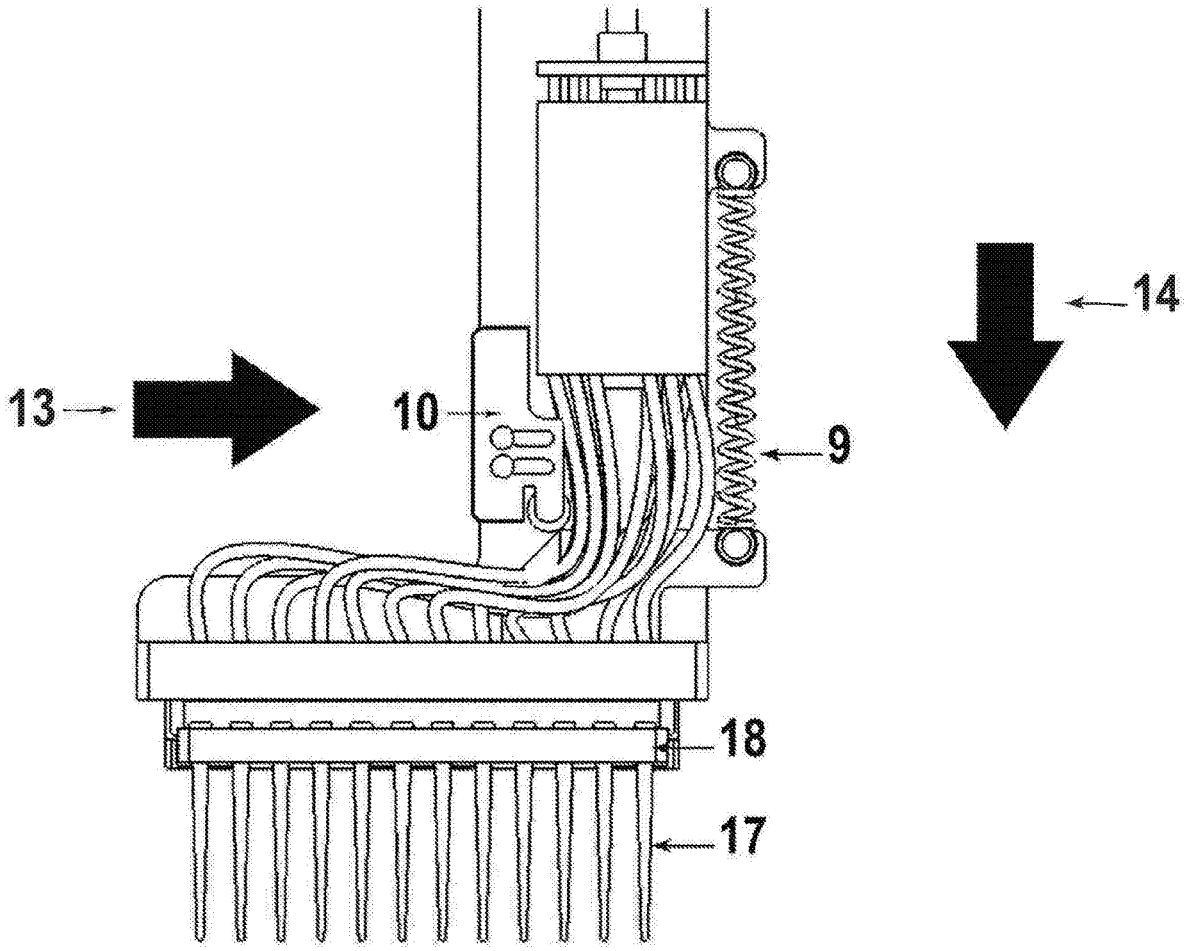
FIG. 9 is a side view that shows the row of pipette tips rested on the pipettor and the clamping mechanism in the tip unload position.

The method for unloading the tips 17 is shown in FIG. 9. When the operator is ready to unload the tips, the trigger button 10 is pressed with a sideways force 13 which will then stretch the spring 9 and cause a downward force 14 to be applied to the clamp 8. This will cause the clamp 8 to move to the lowered position. In this position, there no longer is any force applied to the collar 18. The operator simply needs to tilt the pipettor slightly to the side and the collar 18 with the tips 17 will fall out and can be disposed of. The pipettor is now ready for the next pipetting operation.

The invention is an entirely new and novel way to manufacture a handheld multichannel handheld air displacement pipettor using disposable tips that addresses the shortcomings of the prior art.

An advantage of the invention compared to the current art is that an upward clamping force applied to a rigid collar which holds the pipette tips is used rather than the traditional method which requires the user to apply high downward force to the pipettor onto the tips in order to effect a seal. The reduction of the tip sealing force and the elimination of the requirement to constantly "bang downward" simplifies the use of the handheld pipettor and reduces the chances for repetitive stress injuries.

Another advantage of the invention is that the pipette tips are held firmly in place within the collar when it is clamped to the pipettor mechanism. Once the upward clamping force has been applied, the tips will be locked into place; furthermore this operation will be repeatable for every tip loading operation since the clamped tip collar will always have the same tolerance. Unlike the prior art where there can be varying positions of the tips after each tip loading operation depending on how hard and skillfully the user pressed down to load the tips, with the current invention the tips will be at the same height and will be held in a precise and reproducible manner. This will improve the precision and accuracy of the pipetting results.

Yet another advantage of the invention is that the process of unloading the tips is as easy as the loading process, again reducing the amount of force required to unload the tips and reducing the stress on the user.

Yet another advantage of the invention is that no sealing protuberances are present in the design. These sealing protuberances as used in the prior art require that the top portion of the pipette tips be forced over and onto the protuberances. In order to achieve an airtight seal with such a design the tolerances for the protuberances and the tips are very tight and the design and manufacturing costs are higher. The design of the current invention which eliminates the sealing protuberances is simpler, more reliable, and lower in cost to manufacture. The current invention also makes it easier to use a variety of different disposable tips since with the mechanism for the same reasons.

What is claimed is:

1. A pipette tip loading and unloading mechanism for holding a single row of pipette tips in a multichannel handheld air displacement pipettor, comprising:

a frame;

a gasket in a cavity of the frame, wherein the gasket comprises a plurality of sealing rings extending into the cavity of the frame and forms a flush surface with the frame facing a clamp;

the clamp movably attached to the frame and configured to hold the single row of pipette tips against the gasket forming a seal between the frame and the pipette tips, wherein at least one portion of the clamp is configured to be located between two pipette tips; and a trigger button mechanically engaging the clamp to move the clamp between a first position for loading the single row of pipette tips and a second position for unloading the single row of pipette tips, wherein the trigger button is moveable in a first direction to engage the clamp, and wherein the clamp is movable between the first position and the second position in a second direction that is perpendicular to the first direction.

2. The pipette tip loading and unloading mechanism of claim 1, wherein the trigger button engages a ramp surface of the clamp.

3. The pipette tip loading and unloading mechanism of claim 1, wherein the clamp is configured to pull the single row of pipette tips toward the frame to form the seal between the frame and the pipette tips.

4. The pipette tip loading and unloading mechanism of claim 1, further comprising:

at least one spring attached between the clamp and the frame for providing a tension force to maintain the seal between the frame and the pipette tips.

5. The pipette tip loading and unloading mechanism of claim 1, wherein the at least one portion of the clamp is configured to pull a collar holding the single row of pipette tips.

6. A method of loading and unloading pipette tips for a multichannel handheld air displacement pipettor comprising a frame, a gasket in a cavity of the frame, and a clamp movably attached to the frame, the method comprising:

moving a trigger button in a first direction such that the clamp moves in a downward direction that is perpendicular to the first direction to load a single row of pipette tips, wherein at least one portion of the clamp is configured to be located between two pipette tips; and moving the trigger button in a second direction such that the clamp moves in an upward direction that is perpendicular to the second direction to hold the single row of pipette tips against the gasket forming a seal between the frame and the pipette tips.

7. The method of claim 6, wherein the gasket comprises a plurality of sealing rings extending into the cavity of the frame and forms a flush surface with the frame facing the clamp.

8. A pipette tip loading and unloading mechanism for holding a single row of pipette tips in a multichannel handheld air displacement pipettor, comprising:

a frame;

a gasket in a cavity of the frame;

a clamp movably attached to the frame and configured to hold the single row of pipette tips against the gasket forming a seal between the frame and the pipette tips, wherein at least one portion of the clamp is configured to be located between two pipette tips; and a trigger button mechanically engaging the clamp to move the clamp between a first position for loading the single row of pipette tips and a second position for unloading the single row of pipette tips, wherein the trigger button is moveable in a first direction to engage the clamp, and the clamp is movable between the first position and the second position in a second direction that is perpendicular to the first direction.

* * * * *